United States Patent [19]

Kern

[11] 4,092,814

[45] June 6, 1978

[54] REINFORCING ROD

[75] Inventor: Georg Kern, Munich, Germany

[73] Assignee: Dyckerhoff & Widmann Aktiengesellschaft, Munich, Germany

[21] Appl. No.: 556,465

[22] Filed: Mar. 7, 1975

[30] Foreign Application Priority Data

Mar. 15, 1974 Germany ..... 2412459

[51] Int. Cl.[2] ..... E04C 3/30

[52] U.S. Cl. ..... 52/730; 52/739; 61/45 B

[58] Field of Search ..... 52/739, 740, 730, 733, 52/230; 61/45 B

[56] References Cited

U.S. PATENT DOCUMENTS

| | | | |
|---|---|---|---|
| 2,191,233 | 2/1940 | Herzka | 52/736 X |
| 3,167,882 | 2/1965 | Abbott | 52/730 X |
| 3,561,185 | 2/1971 | Finsterwalder et al. | 52/737 |
| 3,738,071 | 6/1973 | Finsterwalder | 61/45 B X |
| 3,849,992 | 11/1974 | Murphy | 61/45 B |

*Primary Examiner*—Stephen J. Novosad
*Assistant Examiner*—Carl D. Friedman
*Attorney, Agent, or Firm*—Orville N. Greene; Frank L. Durr

[57] ABSTRACT

A reinforcing member, especially suitable for anchoring to the earth or to a rock, is made up of two or more separate rods which are shaped to fit together to provide a unit with a generally round cross-section and with spiral ribs on the outer surfaces of the unit. Each of the separate rods which make up the member or unit, have two flat surfaces which are radial with respect to the circular unit and which interfit in surface to surface contact with corresponding surfaces of the complementary rods, except that recesses are provided at the interior ends of the radial surfaces which together form a central conduit in the assembled unit. The central conduit may be employed, per se, as an injection conduit for mortar to fix the end of the rod in an anchoring rock for example, or it may act as venting means to assure that air is not retained in hole boring in which the unit is to be secured by mortar or cement. A tubular pipe may be included in the hollow center to facilitate injection or venting. Preferably also, the edges adjacent the outer portion of the flat radial surfaces of the individual rods are rounded off. Tubes for the injection of mortar or venting of air may also be provided in the space formed by the rounded off edges of the rods of the unit.

2 Claims, 3 Drawing Figures

REINFORCING ROD

The invention relates to a reinforcing member or unit consisting of at least two individual rods, each with an approximate sector of a circle cross-section, the individual rods being parallel to one another and so arranged that the total cross-section thereof is circular in outline.

A reinforcing unit or member made up of several individual elements which together have a circular cross-section, has the advantages primarily for the production of stays or guys one end of which is anchored in the earth or rock. For producing such guys, a hole is first bored into the earth or rock and a tensioning member is inserted into this bore hole. Then the cavern between the tensioning member and the wall of the bore hole is filled with mortar-cement under pressure in the lower area of the tensioning member. This mortar forms, after hardening, the so called compressed body which transmits the force from the tensioning member to the earth or rock. The tensioning member can be stressed in order to exert compressive stress on the earth or rock.

For the production of the bore holes, the expenditure of time and machines is so much the greater, the greater the diameter of the bore hole is; the diameter of the bore hole can be made so much smaller, the less the total cross-sectional size of the tension member is. The total cross-sectional size of the tensioning member comprises not only the static effective cross-section of steel, but also the measures taken for the protection of steel against corrosion, e.g., a cover tube, above all an injection conduit adapted to bring the mortar to the depth of the bore hole, and also, if necessary, a venting conduit adapted to allow entrapped air in the bore hole to escape.

The safety of the anchor and the corrosion protection depend decidedly on the faultless formation of the compressed body. Thus, the injection and venting conduits have special importance, which is greater the deeper the bore hole is, and the tougher the earth ratios are, while the formation of the compressed body in the depth of the bore hole cannot be optically controlled.

The injection or venting conduits consist, in most cases, of thin tubes made from synthetic material or sheet metal, which are positioned outside of the tensioning member. They are attached to the tensioning member and are led into the bore hole with it. The positioning of the injection and venting tubes outside the tensioning member stipulates a larger bore diameter. Since the tensioning member for high anchoring force is heavy and unwieldy and the bore hole is narrow, the danger exists that the lines will be damaged by insertion into the bore hole. Damaging the lines impairs the production of the compressed body.

In comparison with the diameter, a massive steel rod has the smallest profile for a tension member. These cannot be manufactured in any large diameter by the basic rolling techniques, except under conditions where uniform homogeneous cross-sections are not obtained. By employing bundles of several steel rods or wires of round cross-section, the total cross-section of the tension member is proportionately large. On this basis, straight tension elements which consist of several individual elements which are not round in cross-section, but which can be fitted together to form a round, compact assembly, are advantageous.

The objects of the invention are, to reduce the expense for the disposition of such injection and venting lines in a very compact tension member for burying in the ground or rock, to hold the requirements for space occupied by such lines as small as possible, to diminish the danger of eventually damaging these lines and to increase the safety of such anchors.

The invention provides an improved reinforcing member of the type which is made by assemblying two or more individual rods by forming the rods, as by hot rolling, to provide helically curved and threading ribs on outer surface of the sector, flat radial surfaces for contacting with similar radial surfaces of the other individual rods and a recess at the middle area with respect to the assembled circular unit extending the entire length of the rods, whereupon a central hollow space is formed in the assembled member extending throughout the total length thereof. The recesses appropriately are geometrically similar in cross-section to the cross-section of the individual elements.

Injection and/or venting lines may be arranged in the hollow space. The hollow space can also, itself, be formed so as to serve as an injection or venting canal.

In the latter case, it is practical to round off the outer edges formed where curved outer surface and the radial inner surfaces of the individual rods ordinarily would meet.

The invention is based on the realization that when the individual rods contact one another with smooth surface to surface contact and closed joints, it is possible with proportionately lower expenditures, through the disposition of recesses on the individual rods in the area of the middle point of circumferential circle of the assembly, to make a hollow space extending throughout the tension member of ring form cross-section, which is shielded against outside influences. This hollow space can be employed as an injection conduit and/or venting pipe. It is possible thereby to accommodate an injection or a venting pipe in the central space; both injection and venting pipes can also be provided simultaneously wherein either one pipe is provided whose cross-section is less than the cross-section of the hollow space, so that the remaining surrounding space can act as a return conduit or a pipe with several canals can be provided.

It is, however, especially advantageous to use the central hollow space all together as an injection canal. The necessary cohesion of the individual rods over the entire length of the tension member, can be obtained for the tight closure of the hollow space, when the individual rods are provided with ribs on their outer surface which form a screw-thread, by screwing nuts thereon. It is also possible to hold the individual rods together through bands applied under tension.

Where the individual rods have been rounded off at the intersection of the circle sector outer surface and the radially contacting surface, additional tube lines can be arranged in the resultant wedge shaped open areas, and these additional tubes do not undergo stress at any place in the bore hole, but are protected against injury in similar ways as is a conduit line arranged in the central hollow space of the assembled member.

The invention will now be further explained with reference to the drawing. In the drawing.

Figure 1:
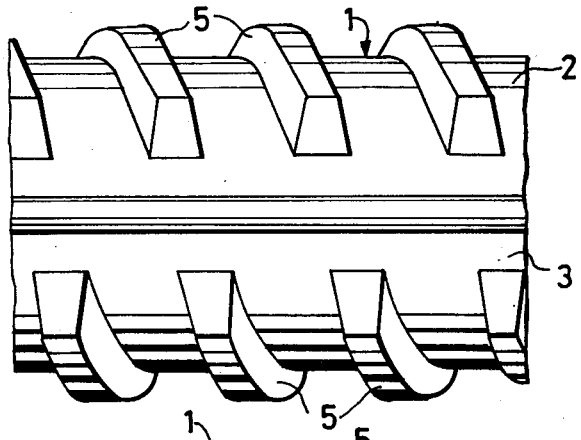
FIG. 1 is a side view of a section of a reinforcing member or unit made according to the invention.
Figure 2:
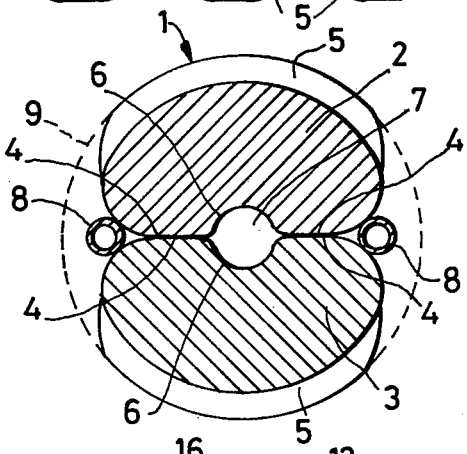
FIG. 2 is a cross-sectional view of the reinforcing member of FIG. 1.

The reinforcing member of FIG. 1 and 2 consists of two approximately semicircularly shaped single rods 2 and 3, which are in contact with one another at the radial surfaces 4 thereof. The individual rods 2 and 3 are provided with ribs 5 in their outer circumferential portions, such as formed by hot rolling and which together form one or more pitched threads on which an anchoring body (not shown) may be screwed. In the central part, each individual rod 2 and 3 has a recess 6 extending the length thereof. The recesses together form a hollow space 7 of approximately circular shape which can serve for the injection of cement-mortar, or as an air-venting canal. In this hollow space 7, an injection or air-venting tube or conduit, similar to the tubes 8 can also be inserted. In FIG. 2, the conduits 8 are shown outside the surface of the tension member, but within the generally circular circumference 9 of the member 1.

Figure 3:
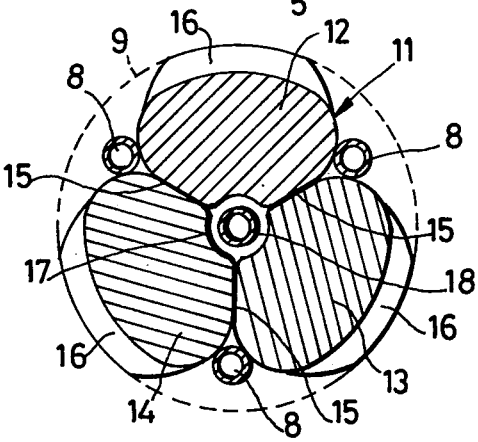
FIG. 3 is a cross-sectional view similar to FIG. 2, but showing another embodiment of the invention.

FIG. 3 shows a cross-section of a reinforcing member 11, which consists of three individual rods 12, 13 and 14. These three rods are in contact through pairs of flat radial surfaces 15, and the rods are provided in their outer circumferential surfaces, with ribs 16, which together extend along a helical curve and form a screw threading. The corresponding recesses in the central part of each of the three rods cooperate to form the hollow space 9, in which the pipe 18 can be employed as an injection canal or as an air venting canal. If desired, additional pipes 8 can be provided outside the rods, but within the total circular outline 9, indicated in dotted lines.

I claim:

1. A steel reinforcing member especially suitable as a tensioning member, one end of which is embedded in a dead end type of borehole and having a continuous central passage therethrough suitable for injecting cementing material into, or for venting air from such a borehole, comprising at least two individual, continuous steel rods each having the approximate cross-sectional shape of a sector of a circle so that each rod comprises two radial flat longitudinal surfaces and a circumferential surface, said rods being assembled with the adjacent radial surfaces of the rods in contact to form the reinforcing member with a cross-section which is substantially circular, the circumferential surfaces of each of said rods containing ribs thereon so constructed as to form a helical pattern on the assembled member, each of said rods having a recess extending the entire length thereof in the region where the two radial surfaces would meet to provide said continuous central passage, the outer edges of at least one pair of contacting radial surfaces of the assembled member being rounded off to form a recess in the circumferential portion of the assembled member, and a conduit tube positioned along said circumferential recess.

2. A steel reinforcing member especially suitable as a tensioning member one end of which is embedded in a dead end type of borehole and having a continuous central passage therethrough suitable for injecting cementing material into, or for venting air from such a borehole, comprising at least two individual, continuous steel rods each having the approximate cross-sectional shape of a sector of a circle so that each rod comprises two radial flat longitudinal surfaces and a circumferential surface, said rods being assembled with the adjacent radial surfaces of the rods in contact to form the reinforcing member with a cross-section which is substantially circular, the circumferential surfaces of each of said rods containing ribs thereon so constructed so as to form a helical pattern on the assembled member, each of said rods having a recess extending the entire length thereof in the region where the two radial surfaces would meet to provide said continuous central passage, the intersecting edges between at least one of the radial surfaces of the individual rods and the circumferential surface thereof being rounded off.

* * * * *